US005879124A

United States Patent [19]

Brouwer et al.

[11] Patent Number: 5,879,124

[45] Date of Patent: Mar. 9, 1999

[54] VEHICLE WITH RETRACTIBLE REAR WHEEL ASSEMBLY

[75] Inventors: Gerardus J. Brouwer, R.R. #2, Concession 5, Keswick; Dan Dvorak, Toronto, both of Canada

[73] Assignee: Gerardus J. Brouwer, Keswick, Canada

[21] Appl. No.: 843,325

[22] Filed: Apr. 14, 1997

[51] Int. Cl.[6] ..... B66F 9/20

[52] U.S. Cl. ..... 414/631; 180/209; 180/906; 280/149.2

[58] Field of Search ..... 414/631–638, 414/664, 667, 668, 671, 544; 280/149.2; 180/209, 298, 901, 906

[56] References Cited

U.S. PATENT DOCUMENTS

| | | | |
|---|---|---|---|
| 3,490,633 | 1/1970 | Avis et al. | 414/634 |
| 3,610,453 | 10/1971 | Goodacre | 414/631 |
| 3,684,114 | 8/1972 | Cosgrove et al. | 414/544 X |
| 3,703,969 | 11/1972 | Shaffer et al. | 414/634 X |
| 3,710,965 | 1/1973 | Joosten | 414/467 |
| 3,799,379 | 3/1974 | Grether et al. | 414/467 |
| 3,908,849 | 9/1975 | Carroll | 414/634 |
| 4,061,237 | 12/1977 | Austin et al. | 414/467 |
| 4,365,921 | 12/1982 | Brouwer et al. | 414/631 X |
| 4,396,341 | 8/1983 | Brouwer et al. | 414/467 |
| 4,435,113 | 3/1984 | Mosely et al. | 414/347 |
| 4,439,102 | 3/1984 | Allen | 414/633 |
| 4,611,683 | 9/1986 | Hilmer | 180/209 |
| 5,174,415 | 12/1992 | Neagle et al. | 187/234 |
| 5,326,217 | 7/1994 | Simpson et al. | 414/635 |
| 5,328,321 | 7/1994 | Moffett et al. | 414/637 X |
| 5,386,121 | 1/1995 | Priefert | 180/209 |
| 5,409,346 | 4/1995 | Grether | 414/635 X |
| 5,641,261 | 6/1997 | Talbert et al. | 414/635 X |
| 5,651,658 | 7/1997 | Holmes et al. | 414/635 |

FOREIGN PATENT DOCUMENTS

| | | | |
|---|---|---|---|
| 104614 | 8/1966 | Denmark | 414/635 |
| 1385550 | 7/1964 | France | 414/632 |
| 1506974 | 7/1969 | Germany | 414/631 |
| 239084 | 9/1990 | Japan | 414/664 |
| 2000983 | 10/1993 | Russian Federation | 180/906 |
| 368747 | 5/1963 | Switzerland | 414/631 |

*Primary Examiner*—David A. Bucci
*Attorney, Agent, or Firm*—Bereskin & Parr

[57] ABSTRACT

A collapsible forklift vehicle has three frame sets, namely a main frame, a pair of front wheel frames which can be retracted into the main frame, and a mast frame which runs partly on the main frame and partly on the front wheel frames. The main frame defines a rear space for the rear wheels, and motor and operator platforms, all of which can be retracted into the rear space to shorten the vehicle for transport. The mast, carried by the mast frame, includes intermediate channels running in outer channels using top and bottom rollers, enabling the use of lighter gauge steel for the mast.

15 Claims, 14 Drawing Sheets

VEHICLE WITH RETRACTIBLE REAR WHEEL ASSEMBLY

FIELD OF THE INVENTION

This invention relates to an improved forklift vehicle. In particular it relates to a vehicle, e.g. a forklift vehicle, in which the rear wheel assembly, and optionally also the front wheel assembly, is retractable to reduce the length of the vehicle so that it can be carried more easily at the rear end of another vehicle. The invention also deals with other features of a forklift vehicle, as will be described.

BACKGROUND OF THE INVENTION

Vehicles such as forklift vehicles must often be carried from one location to another. It is common to do so by carrying the forklift vehicle on the rear end of another vehicle, such as a tractor trailer. However since the forklift vehicle then projects rearwardly from the tractor trailer, the combined length of the two vehicles can be unduly long. In addition the leverage on the rear axle of the tractor trailer, created by the overhanging forklift vehicle, can be unacceptably high. For this reason it is known to have portions of a forklift vehicle which are retractable, so that the vehicle will occupy less length or otherwise will occupy a smaller space.

For example, U.S. Pat. No. 4,061,237 issued Dec. 6, 1977 shows a forklift vehicle in which the front wheel portion of the vehicle can be retracted to a position such that the front to rear dimension of the vehicle is shortened.

U.S. Pat. No. 5,174,415 issued Dec. 29, 1992 shows another forklift vehicle in which the front wheels and their support arms can be swung upwardly, again to reduce the front to rear length of the vehicle.

U.S. Pat. No. 3,799,379 issued Mar. 26, 1974 shows yet another forklift vehicle in which the front wheels and their support arms are retractable to reduce the overall length of the vehicle.

U.S. Pat. No. 3,908,849 issued Sep. 30, 1975 shows a form of forklift vehicle which is collapsible to a tripod arrangement, again to reduce the overall length of the vehicle.

The forklift vehicles shown in the above mentioned patents suffer from various difficulties. One of these difficulties is that since the rear wheels in the vehicles shown are not retractable, the over all length of the vehicles remains relatively substantial.

SUMMARY OF THE INVENTION

Accordingly, it is an object of the present invention in one of its aspects to provide a vehicle in which the rear wheel assembly is retractable. In this aspect the invention provides a vehicle having a front and a rear and comprising:

(a) a main frame, (b) said main frame including a pair of side members defining a space therebetween, and a support member extending rearwardly in said space, (c) a rear axle mounted on said support member for movement forwardly and rearwardly on said support member, and a rear wheel mounted on said axle, (d) a steering mechanism for steering said rear wheel, (e) and a retraction mechanism coupled between said rear axle and said main frame for moving said rear axle forwardly and rearwardly along said support member to extend and retract said rear axle and said rear wheel.

Further objects and advantages of the invention will appear from the following description, taken together with the accompanying drawings.

DETAILED DESCRIPTION OF PREFERRED EMBODIMENT

Figure 1:
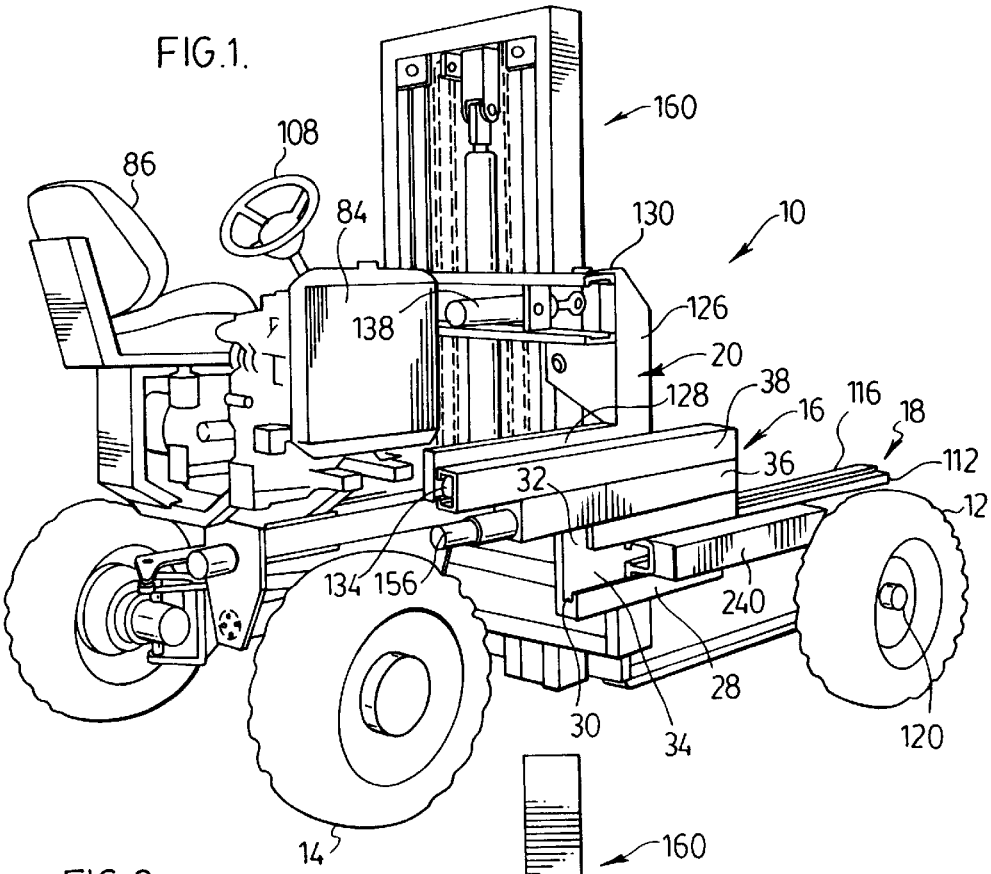
FIG. 1 is a perspective view of a forklift vehicle according to the invention, shown in simplified form and with the front and rear wheels extended.
Figure 2:
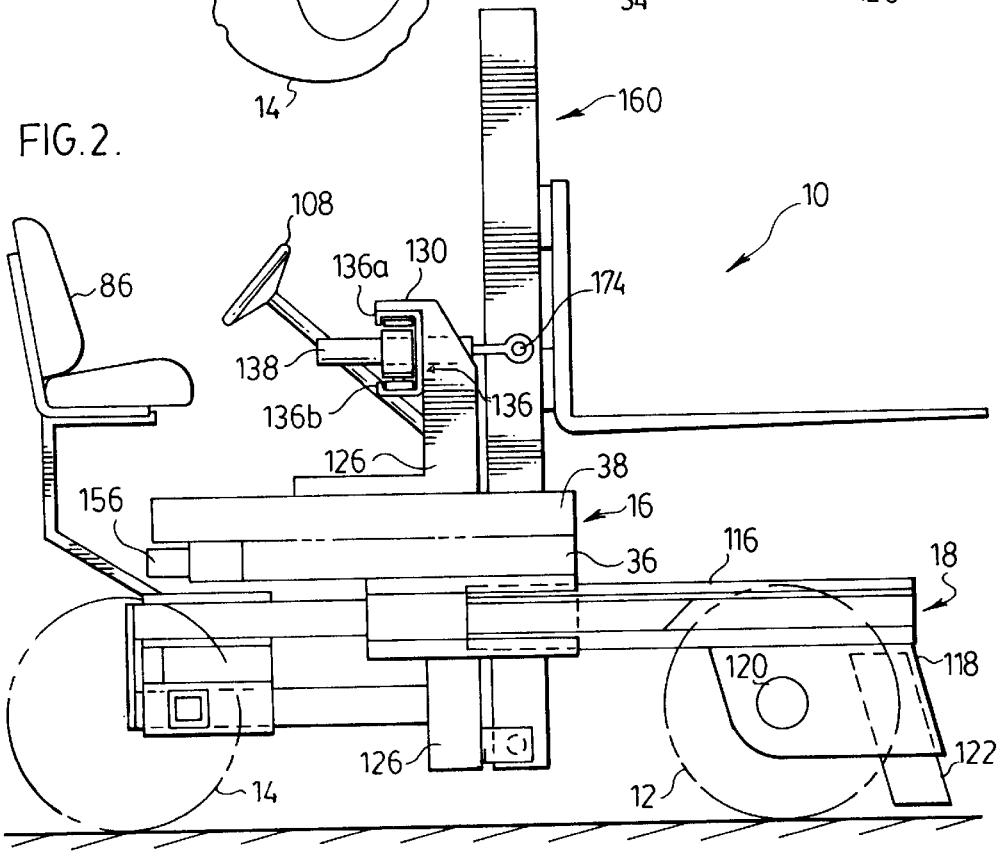
FIG. 2 is a side view of the forklift vehicle of FIG. 1.
Figure 3:
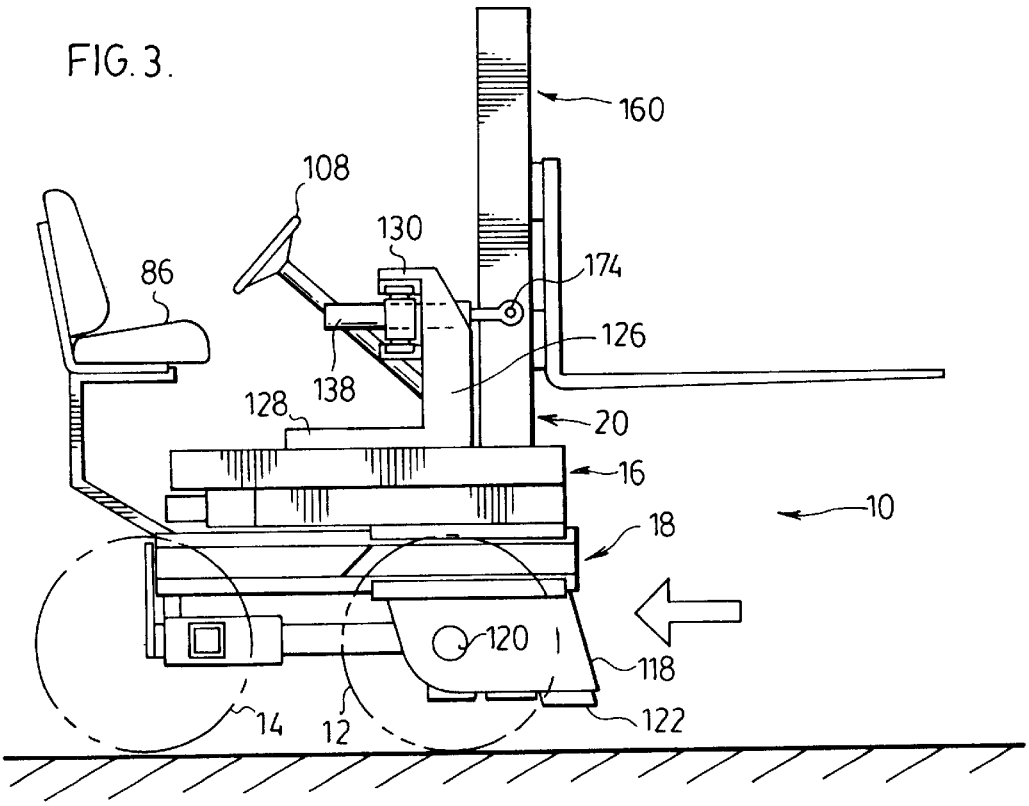
FIG. 3 is a side view similar to FIG. 2 but with the front wheels retracted.

The invention will be described with reference to a forklift vehicle. Reference is first made to FIGS. 1 to 4, which contain over all views of a forklift vehicle 10 according to the invention. The vehicle 10 includes front wheels 12 and rear wheels 14. In the embodiment described, both the front and rear wheels are retractable. FIGS. 1 and 2 show the vehicle with the front and rear wheels 12, 14 in extended position. FIG. 3 shows the vehicle 10 with the front wheels 12 retracted but with the rear wheels 14 still extended. FIG.

4 shows the vehicle 10 with both the front and rear wheels 12, 14 retracted, so that the vehicle occupies only a very small front to rear space.

Figure 5:
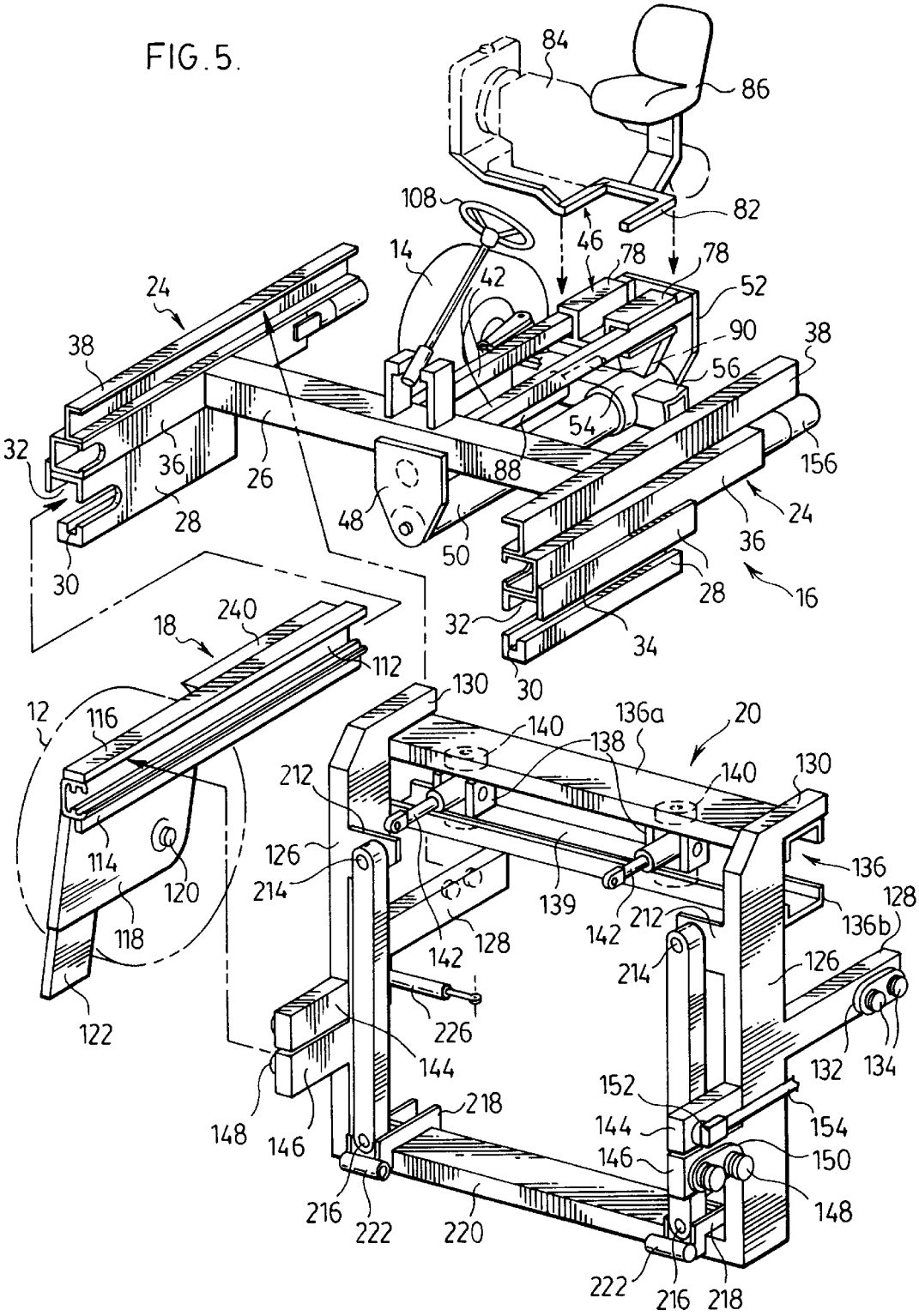
FIG. 5 is a perspective view showing three frames used in the forklift vehicle of FIGS. 1 to 4.

The vehicle 10 includes three frame assemblies (FIG. 5). These are (a) a main frame 16, which supports the rear wheels 14 in a manner to be described, (b) a pair of front wheel frames 18, which are mounted on the main frame 16 in a manner to be described and each of which carries a front wheel 12, and (c) a mast frame 20. The mast frame 20 rides in part on the main frame 16 and in part on the front wheel frames 18, again in a manner to be described.

The main frame 16 will next be described. Main frame 16, which is best shown in FIG. 5, includes a pair of side members 24 joined by a cross beam 26. Each side member 24 includes a lower outwardly facing channel 28 which supports and guides one of the front wheel frames 18. Each channel 28 has for this purpose a lower upwardly facing groove 30, an upper downwardly facing groove 32, and an outwardly facing slot 34.

Each main frame side member also includes an intermediate generally square tube 36 which accommodates a piston rod (to be described) which drives the mast frame 20 forwardly and rearwardly, and an upper inwardly facing channel 38 which supports rollers for the mast frame 20 (as will be described). The cross beam 26 is connected to the inwardly facing sides of the square tubing 36.

Projecting rearwardly from the rear face of cross beam 26 (as shown in FIGS. 5, 6, 7, 9 and 11) are a pair of support tubes 42 (of rectangular tubing) which support a sliding motor and seat subframe 46 (to be described). The cross beam 26 also has, welded to its front face, a downwardly depending plate 48. A large diameter slide tube 50 is attached to and projects rearwardly from the bottom of plate 48. The slide tube 50 and the support tubes 42 are connected together at their rear ends by a vertical connecting plate 52.

Mounted on the slide tube 50 is a slide ring 54. The slide ring 54 is welded to a laterally extending rear axle 56, as best shown in FIGS. 6 to 10. The rear axle 56 carries a pair of rearwardly extending side extensions 58 which carry king pins 60 connected to the hubs 62 of the rear wheels 14. A conventional steering linkage is provided, consisting of steering arms 64*a*, 64*b*, connected to the king pins 60 and joined by a tie rod 66. Steering is performed by a hydraulic piston and cylinder 68 having its rod 70 pivotally connected to one steering arm 64*a* and its butt end pivotally connected at 72 to a tab 74 welded to slide ring 54.

Figure 9:
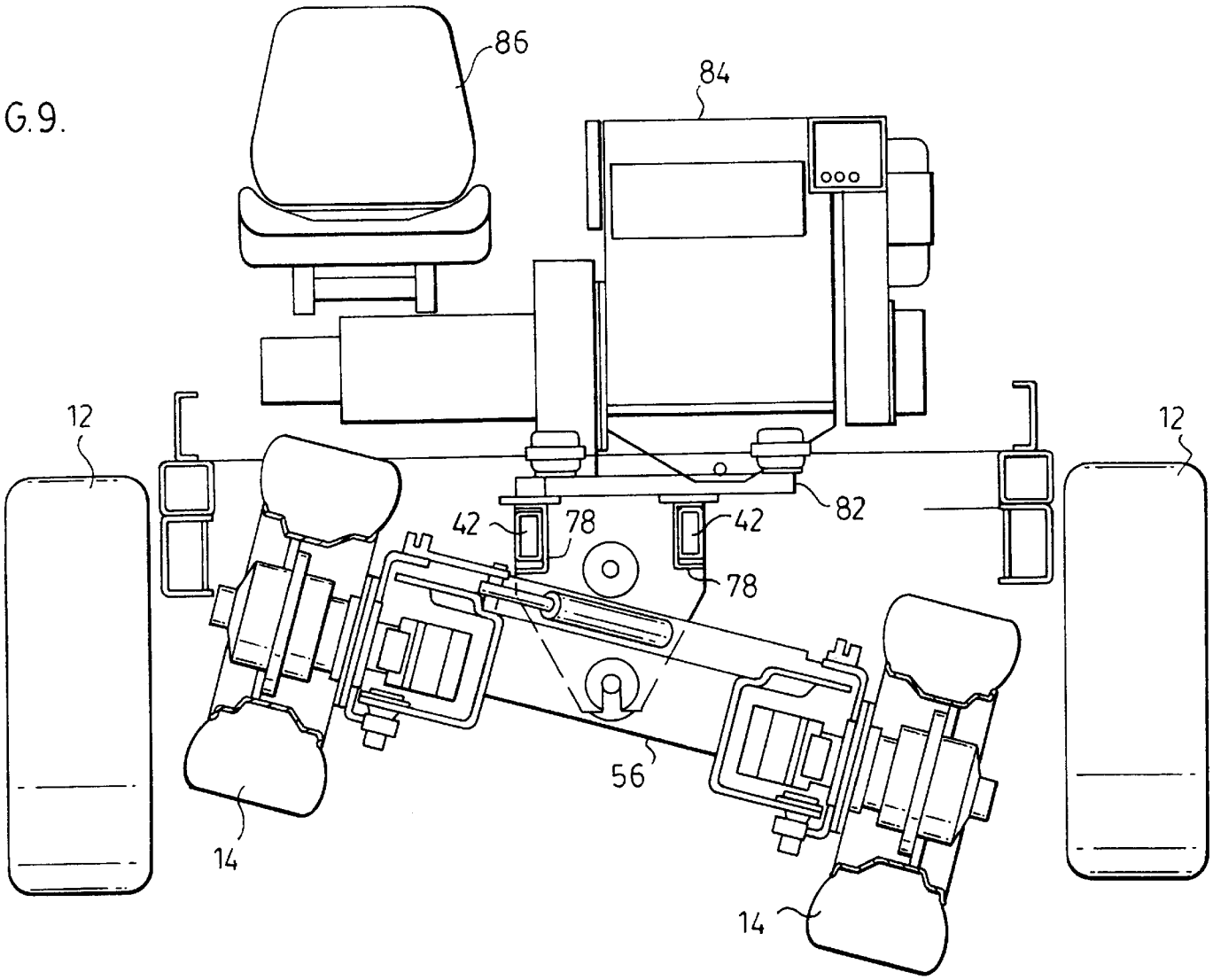
FIG. 9 is a rear view of a portion of the forklift vehicle of FIG. 1 showing the rear wheels tilted.

As will be seen, the rear axle 56 and its associated steering linkage, all mounted on slide ring 54, are able to slide frontwardly and rearwardly on slide tube 50, as indicated in FIGS. 5 to 8. Because the slide ring 54 can rotate on slide tube 50, the rear axle 56 can also pivot from side to side as shown in FIG. 9, to accommodate unevenness in the ground over which vehicle 10 is travelling. If desired, stops (not shown) can be provided to limit the extent of the pivoting.

Located atop the rearwardly extending support tubes 42 is the motor and seat subframe 46 (FIGS. 5 to 9). The subframe 46 is shown in simplified form as including a pair of outwardly facing channels 78, one sliding on each support tube 42. The channels 78 carry and are joined by a platform 82 which carries a motor 84 and a seat 86 for the operator of the vehicle.

Figure 11:
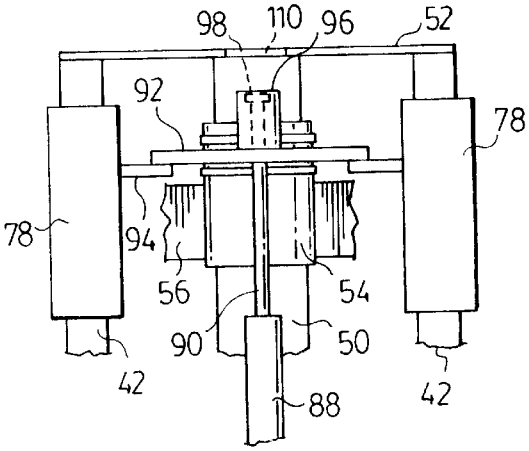
FIG. 11 is a top view showing a portion of the mechanism for extending and retracting the rear wheels.
Figure 10:
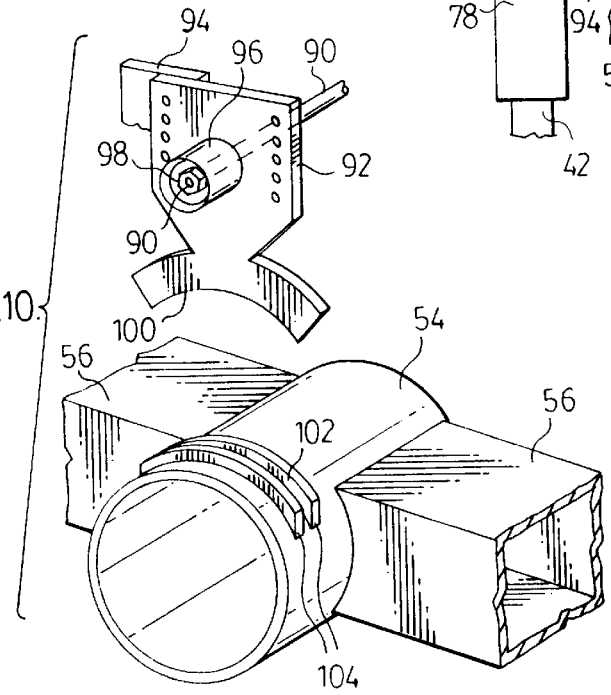
FIG. 10 is a perspective view showing a portion of a mechanism for extending and retracting the rear wheels of the forklift vehicle.

The motor subframe 46 and the rear axle 56 are propelled forwardly and rearwardly by a piston and cylinder 88. The butt end of piston and cylinder 88 is connected to the rear face of downwardly depending plate 48. Piston and cylinder 88 extend rearwardly and the piston rod 90 is connected to a vertically oriented thrust plate 92 (FIGS. 10, 11). Thrust plate 92 is connected to channels 78 (by being bolted to inwardly extending flanges 94 welded to channels 78) and includes a rearwardly extending tube 96 welded thereto, to which rod 90 is connected by nut 98. Thus, when rod 90 is extended and retracted, the channels 78 and motor subframe 46 (with the motor 84 and seat 86) will slide rearwardly and forwardly on support tubes 42.

Figure 4:
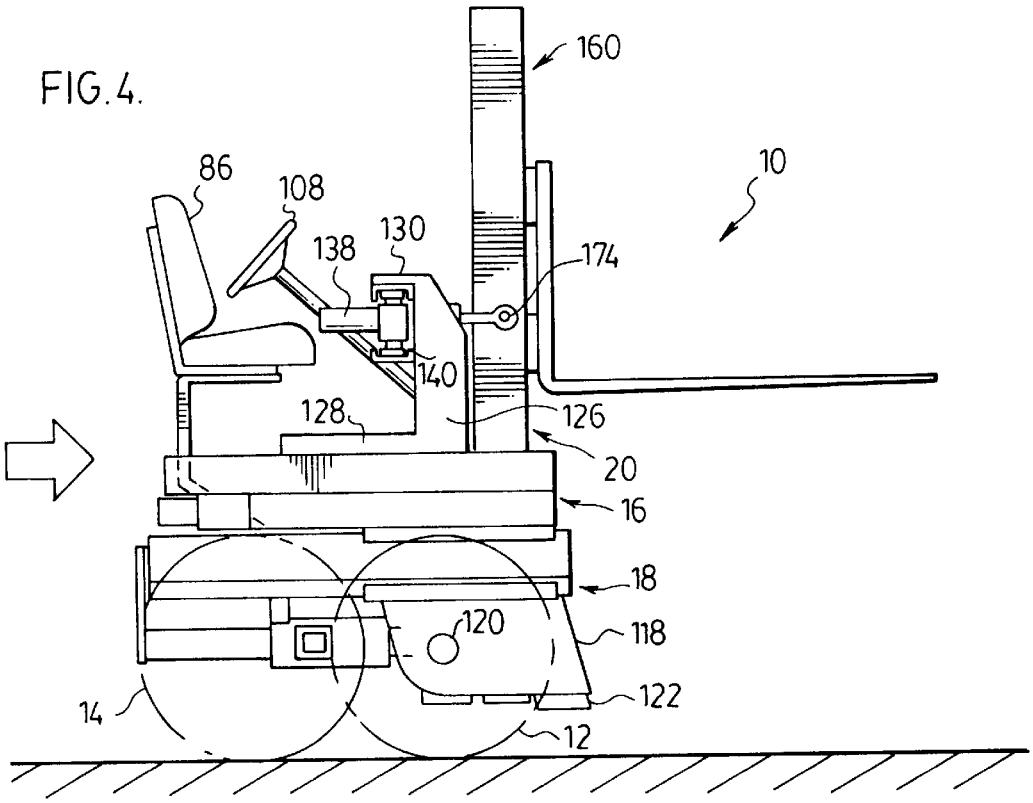
FIG. 4 is a side view similar to FIG. 2 but with both the front and rear wheels retracted.
Figure 6:
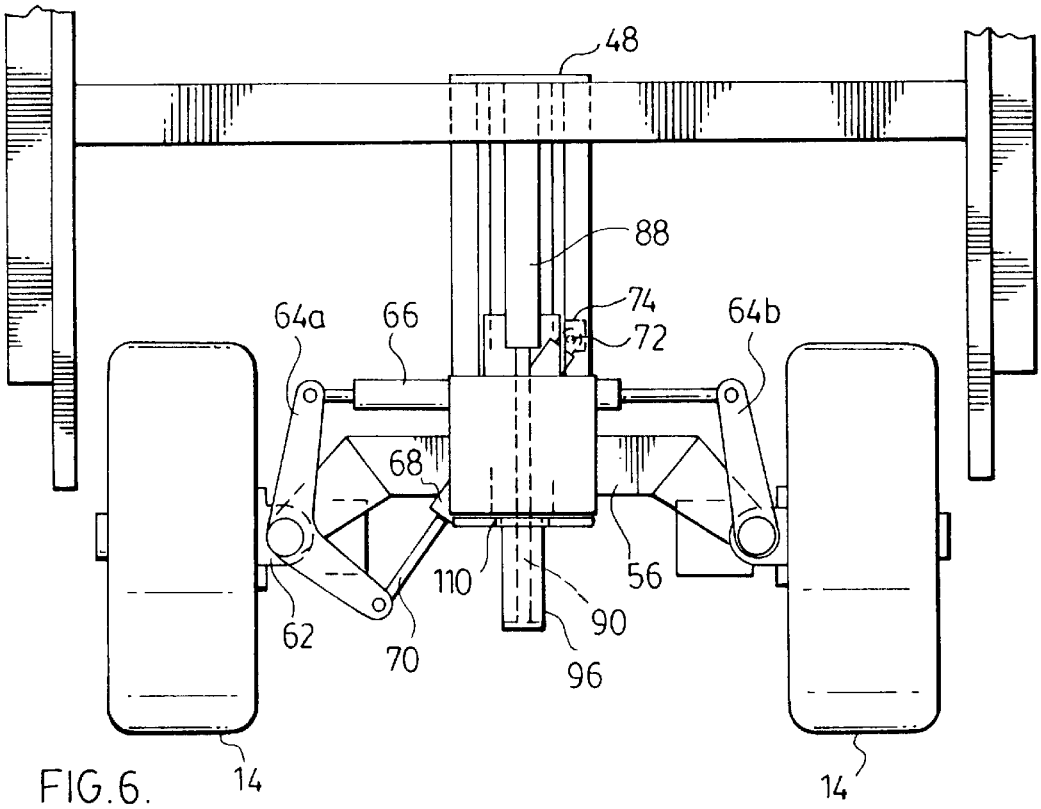
FIG. 6 is a top view showing a rear portion of the forklift vehicle of FIG. 1 with the rear wheels extended.
Figure 7:
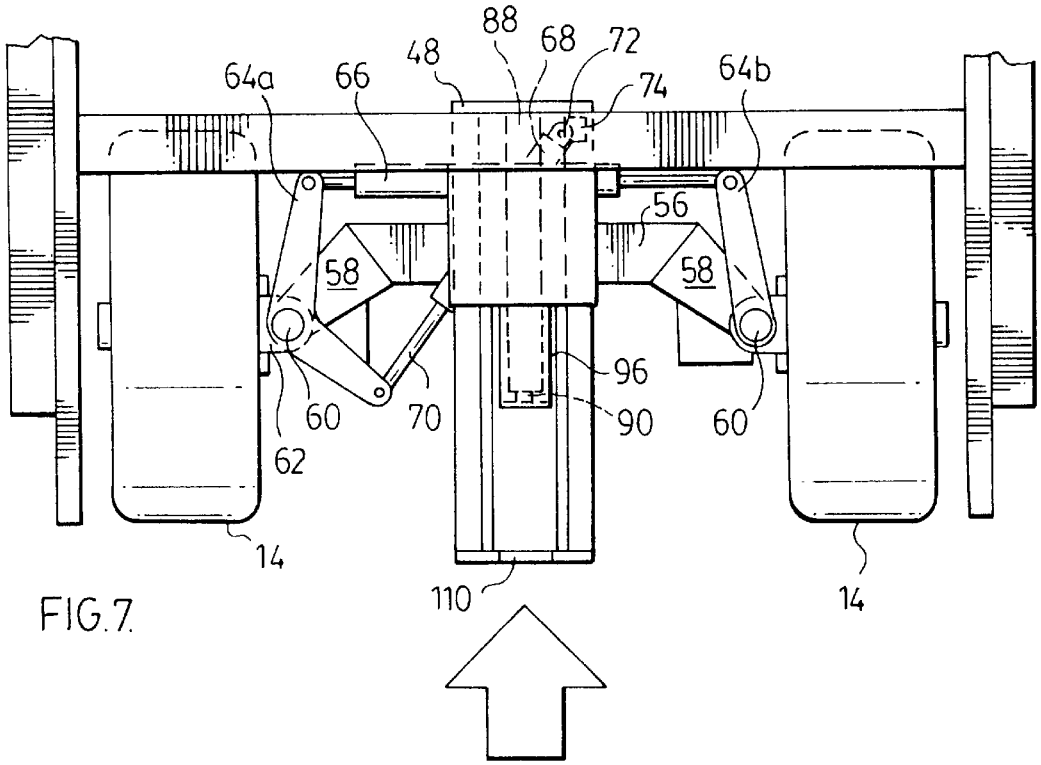
FIG. 7 is a top view similar to that of FIG. 6 but with the rear wheels retracted.
Figure 8:
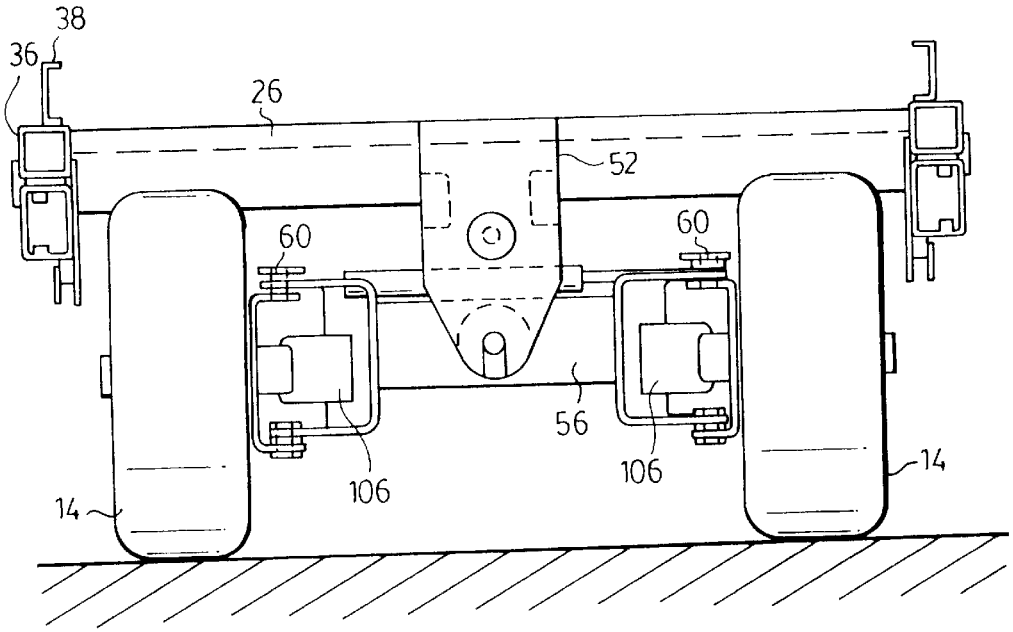
FIG. 8 is a rear view of a portion of the forklift vehicle of FIG. 1 showing the rear wheels level.

Thrust plate 92 extends downwardly from channels 78 and includes an arcuate lower edge 100 (FIG. 10) which rides in a groove 102 formed by two annular section pieces 104 welded to the upper surface of slide ring 54. Thus, when thrust plate 92 is moved forwardly and rearwardly by piston rod 90, thus moving the motor and seat subframe 46 forwardly and rearwardly, the slide ring 54 and rear axle 56 will move forwardly and rearwardly in unison with the motor and seat subframe 46. At the same time, the grooved connection between thrust plate 92 and the slide ring 54 allows the rear axle 56 to pivot from side to side, as shown in FIG. 9. The mechanism described allows the rear wheels 14 to be retracted, as shown in FIGS. 4 and 7 (for transport on a carrier vehicle), or to be extended rearwardly (as shown in FIGS. 1 to 3 and 6) for vehicle operation. When the rear wheels are fully extended rearwardly, tube 96 extends through a hole 110 in downwardly extending plate 52, as shown in FIGS. 6, 7 and 11.

The rear wheels 14 are driven by hydraulic motors 106 at each rear wheel. The hydraulic motors 106 are in turn powered by a pump (not shown) operated by motor 84. The vehicle is controlled by a steering wheel 108, and by accelerator and brake pedals (not shown) all mounted on the cross beam 26, so that the controls stay in a fixed position as the seat slides forwardly and rearwardly.

The front wheel frames 18 will next be described. (See e.g. FIG. 5.) Each front wheel frame 18 includes an inwardly facing channel 112 (to accommodate guide rollers of the mast frame, to be described). Fixed to the bottom of each channel 112 is a frontwardly and rearwardly extending guide bar 114 which rides in the lower groove 30 (FIG. 5) of channel 28 of the main frame 16. Bolted to the top of each channel 112 is a wear bar 116 which rides in the upper groove 32 of channel 28 of the main frame 16.

Attached to the front of each front wheel frame 18 is a downwardly extending front wheel support plate 118, which carries a stub axle 120 for a front wheel 12. Each support plate 118 can also optionally carry a vertically retractable front leg 122, to stabilize the front of the vehicle at desired times.

The front wheel frames 18 may be retracted or extended by the same piston and cylinder (to be described) which drives the mast frame 20 forwardly and rearwardly.

The mast frame 20 is also shown in FIG. 5. As shown, mast frame 20 includes a pair of vertically extending side members 126, each having mid rearwardly extending arms 128 and upper rearwardly extending arms 130. Each mast mid arm 128 has pivotally mounted on its outer surface a plate 132 which carries a pair of double rollers 134. Rollers 134 ride in the upper channel 38 of the main frame 16, thus partially supporting the mast frame 20. Each mast upper arm 130 carries half 136*a* of a lateral slide assembly 136, the other half 136*b* of which is welded to the vertical rear surfaces of side members 126. The slide assembly 136 carries a pair of mast tilt pistons 138 both mounted on a common carrier 139 having rollers 140 so that the carrier 139 and pistons 138 can slide from side to side laterally as the mast (to be described) moves laterally. The rods 142 of pistons 138 are connected to the mast (not shown in FIG. 5 but which will be described) to tilt the mast.

The mast frame side members 126 also each include a pair of frontwardly projecting upper and lower arms 144, 146. Each lower arm 146 includes a pair of outwardly facing double rollers 148, carried on a plate 150 which is pivotally mounted on arm 146. Rollers 148 ride in the channels 112 of the front wheel frames 18, to provide front support for the mast frame 20.

Each upper frontwardly projecting arm 144 carries on its outer surface a pivot block 152 to which is connected the front end of a piston rod 154 which drives the mast frame 20 forwardly and rearwardly. Piston rod 154 extends through square tubing 36 and is connected to a cylinder 156 mounted at the rear end of square tube 36.

Figure 13:
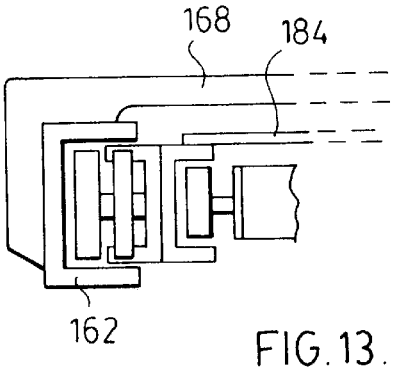
FIG. 13 is a bottom view of a portion of the mast.
Figure 13A:
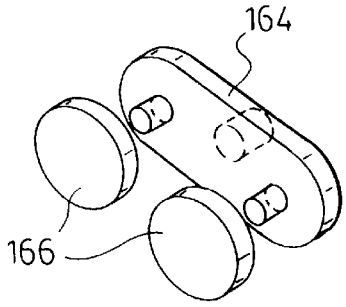
FIG. 13A is a perspective view of rollers and a roller mounting plate used in the mast.

The mast frame 20 carries a mast generally indicated at 160. The mast includes an outer section 161 (FIG. 14) comprising a pair of outer channels 162, each facing inwardly. Each outer channel 162 has pivotally mounted on its inner surface, at its upper end, a roller support plate 164 (see also FIG. 13A) which carries a pair of inwardly facing upper rollers 166. The channels 162 are joined by upper, mid and lower cross members 168, the lowermost of which carries a cylinder support 170 on which is mounted the butt end of a vertically oriented mast cylinder 172.

Figure 12:
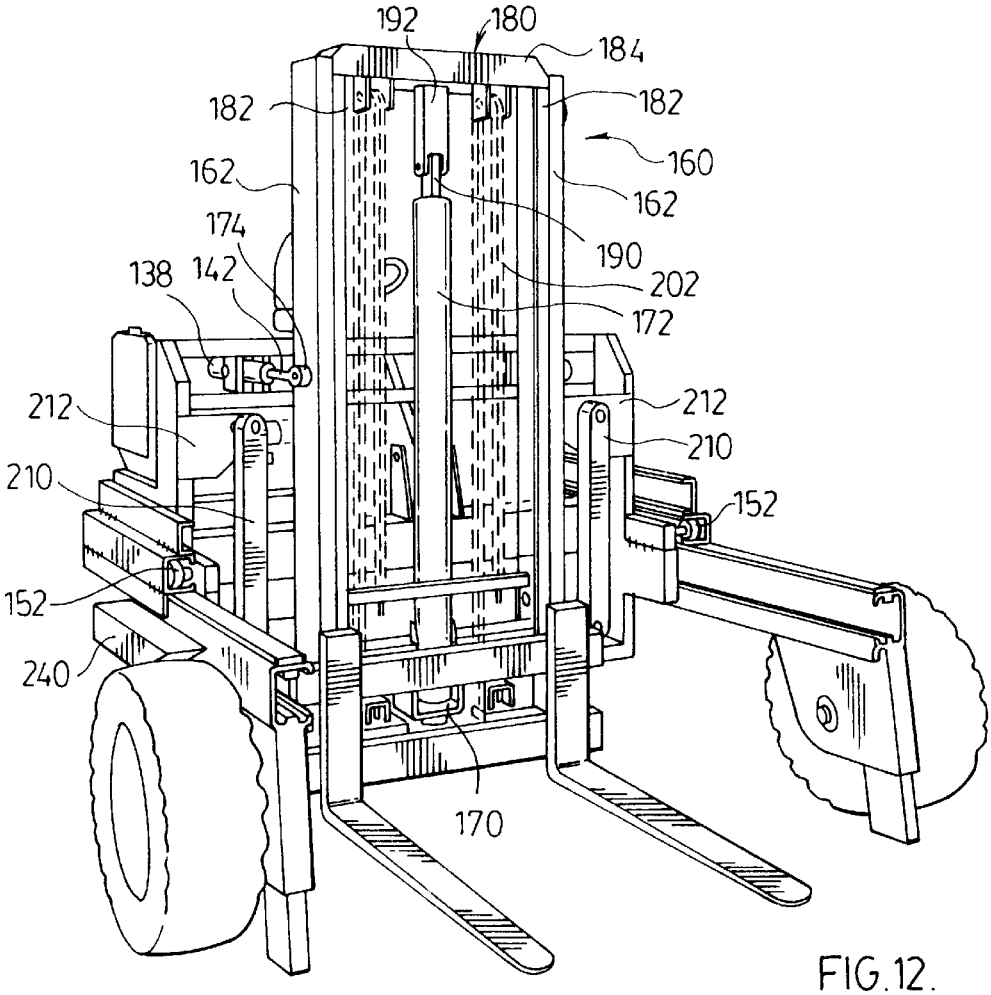
FIG. 12 is a front perspective view of a portion of the forklift vehicle of FIG. 1 and showing the mast.

Each outer channel 162 also includes an outwardly projecting upper pivot 174 to which is connected the piston rod 142 of one of the two mast tilt piston and cylinders 138 (FIG. 12). Each outer channel 162 also includes an outwardly projecting lower pivot 176 to which is connected a mast swing arm as will be described.

The mast 160 also includes an inner mast section 180 (FIG. 14), comprising a pair of vertical outwardly facing intermediate channels 182 joined by upper and mid cross members 184. The channels 182 face into and ride in outer channels 162 and carry at their bottom ends pivotally mounted lower roller support plates 186. The lower roller support plates 186 carry outwardly facing lower rollers 188 which ride in outer inwardly facing channels 162. (In the embodiment shown, plates 186 are actually mounted on lower channels welded to channels 182, as will be described.)

Thus, the inner mast section 180 is guided by both sets of rollers 166, 188 as it moves upwardly and downwardly in outer mast channels 162. The piston rod 190 of mast cylinder 172 is pivotally connected at 192 to the underside of top cross member 184 of inner mast section 180, so that the inner mast section will, be moved upwardly and downwardly as the piston extends and retracts.

Figure 14:
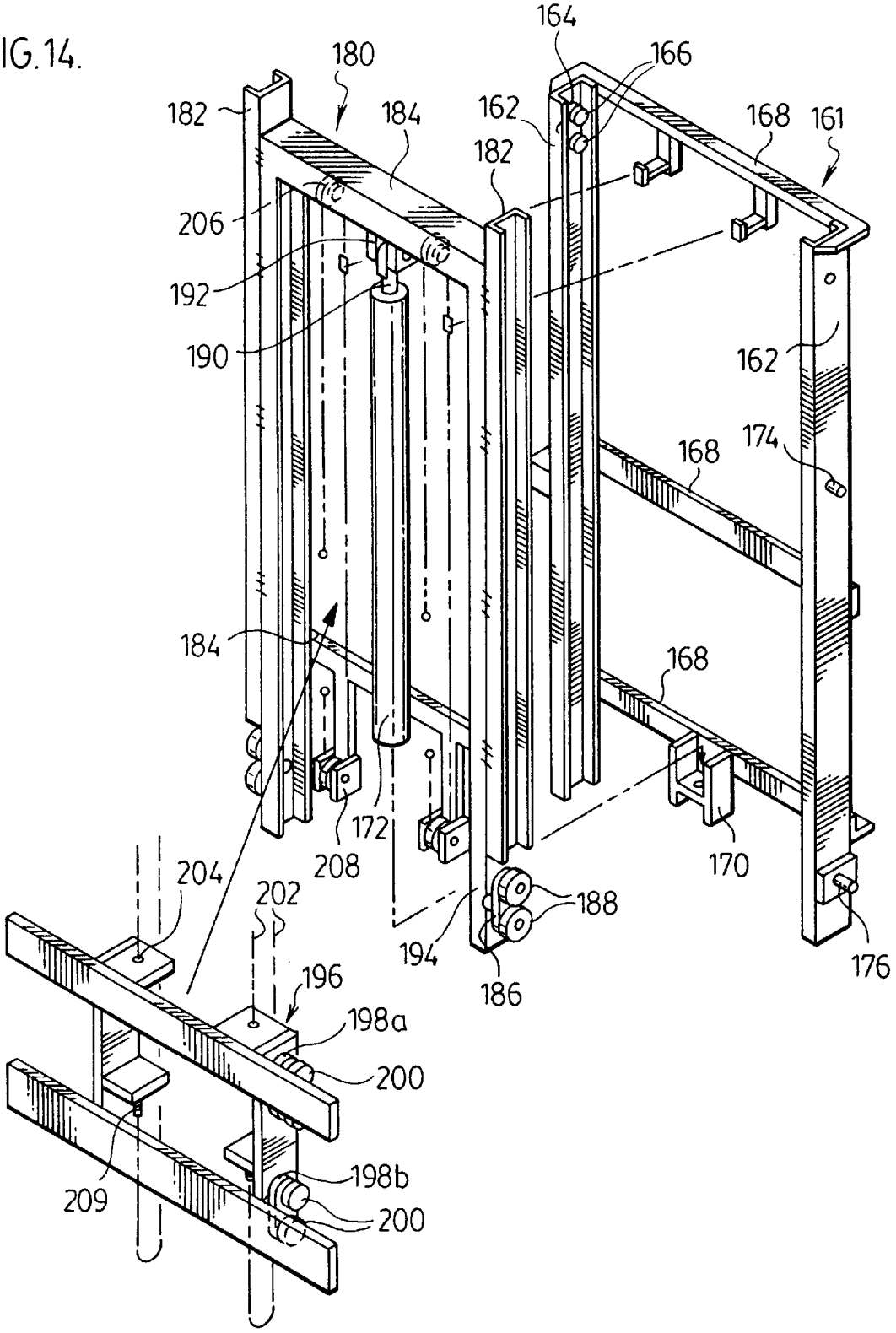
FIG. 14 is a perspective view showing details of the mast.

Inner inwardly facing channels 194 are welded to the inner surfaces of intermediate channels 182 and effectively from part thereof, and also serve as guides for a fork carrier 196 (FIG. 14). The fork carrier 196 is conventional and carries upper and lower roller support plates 198*a*, 198*b* on each side thereof, each of which plates carries a pair of rollers 200. The rollers 200 run in inner channels 194 and guide the fork carrier 196 as it moves up and down.

As is conventional, the fork carrier 196 is connected by chains 202 which extend upwardly from mountings 204 on fork carrier 196, to sprockets 206, and downwardly to mounts 208 extending downwardly from the lower connecting member 168 of outer mast channels 162, and then back to the fork carrier at mount 209. Thus, as mast inner frame 180 is moved upwardly and downwardly by piston and cylinder 172, the movement of the forks 204 is doubled in known manner.

The construction of the mast using outer and intermediate channels 162, 182, which face into and ride on each other, with rollers at their top and bottom as described, allows the use of lighter gauge steel for the mast than has previously been considered practical, while maintaining ample strength. This allows the weight of the vehicle to be reduced.

Figure 15:
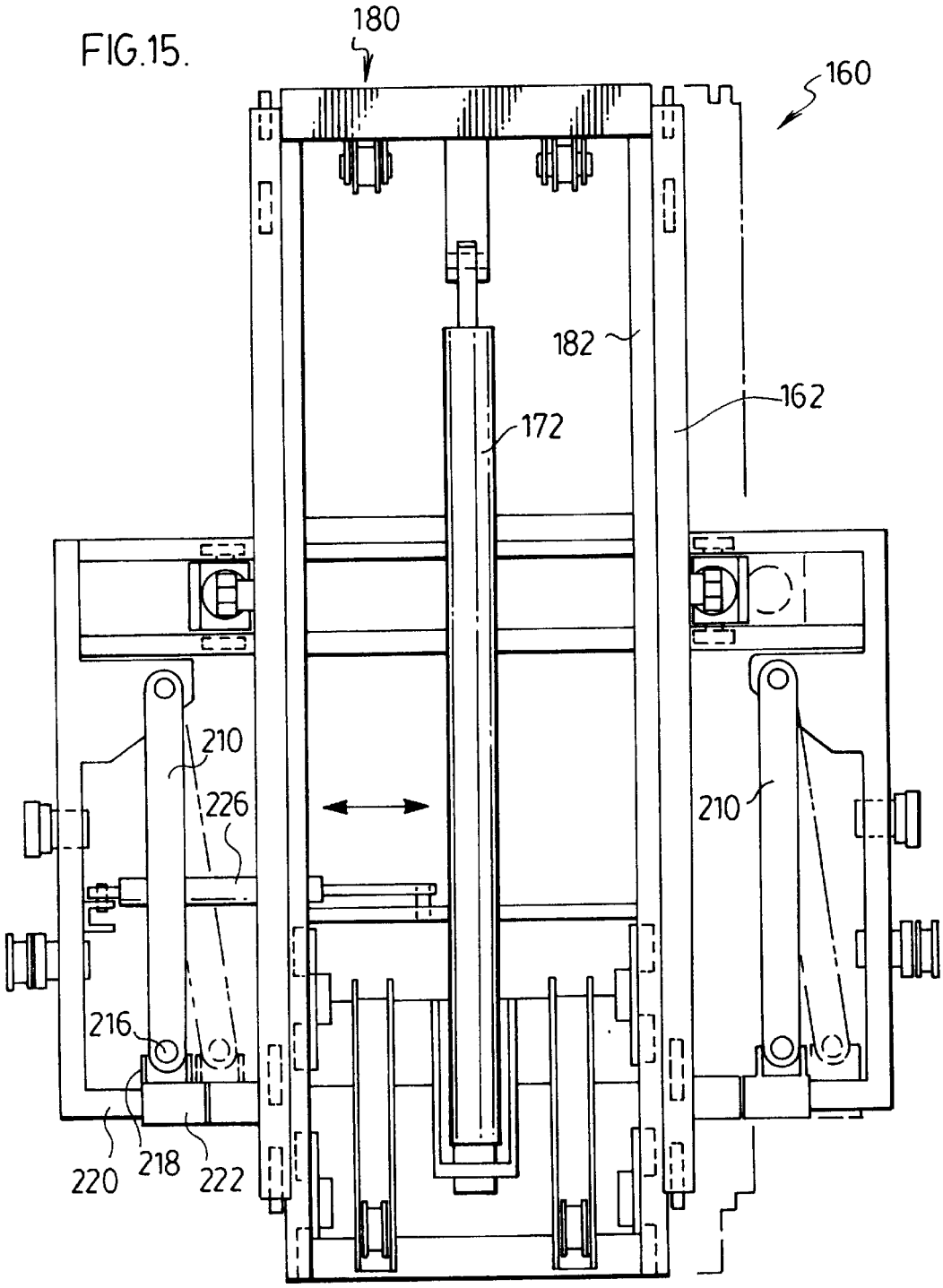
FIG. 15 is a front view of the mast and mast frame.

The mast 160 is side shifted by a pair of swing arms 210 (FIGS. 5, 12 and 15). The swing arms 210 are mounted on plates 212 welded to and extending inwardly from mast frame side members 126. Plates 212 carry fore and aft extending horizontal upper pivots 214 on which the swing arms 210 are mounted, so that the swing arms 210 can swing from side to side.

The swing arms 210 extend downwardly and are pivotally connected at their lower ends, by horizontal fore and aft pivots 216 (FIGS. 5, 15), to slides 218 which can slide across a lower cross member 220 of mast frame 20. Connected to slides 218 are bushings 222 which in turn are connected to the outwardly projecting pivot shafts 176 at the lower ends of mast frame side members 126. A piston and cylinder 226 is connected between one mast frame side member 126 and mast cross member 184. When piston and cylinder. 226 is activated, the mast 160 moves sideways, accomplishing side shifting. An advantage of this arrangement is that it does not require bearings at the bottom of the mast where they are likely to be worn by mud and dirt.

The overall operation of the vehicle described is as follows. When the vehicle is in the extended position shown in FIGS. 1 and 2, it is operated like a conventional forklift vehicle. Since the vehicle shown is a true four wheel vehicle (its rear wheels are widely spaced), it has far more stability than a tricycle type forklift vehicle. (However a single rear wheel in a tricycle arrangement could be used if desired.)

Figure 16:
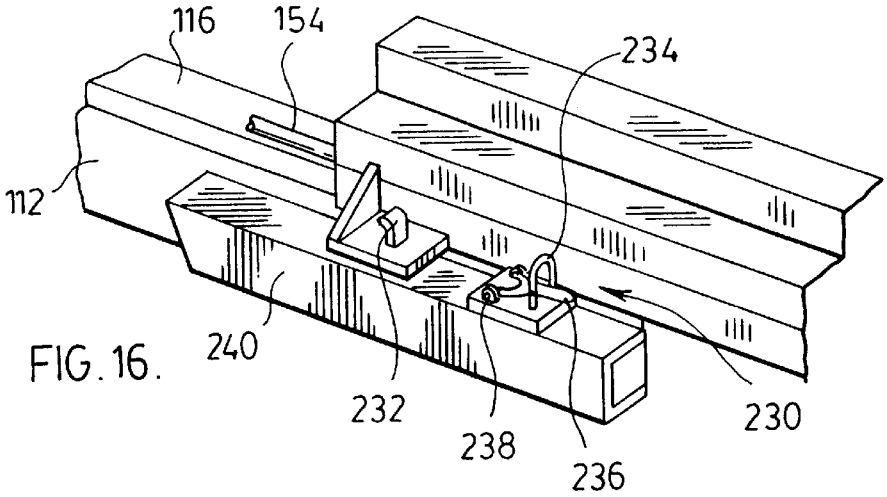
FIG. 16 is a perspective view of a portion of the front and main frames showing a locking latch in unlocked position.
Figure 17:
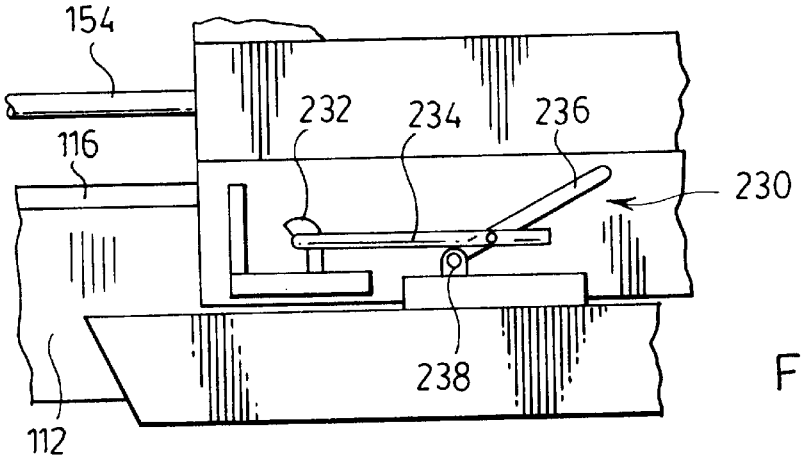
FIG. 17 is a side view of the locking latch and associated mechanism showing the latch in locked position.

When it is desired to retract the wheels for storage on a transport, the front wheels 10 are retracted first. To accomplish this, the pistons and cylinders 156 are extended to drive the mast frame 20 to the front of the vehicle. While this is occurring, and during normal operation, the front wheel frames 18 are locked in position with respect to the main frame 16 by latches 230, best shown in FIGS. 16 and 17. Each latch 230 comprises a forwardly facing hook 232 mounted on the outer side of each square tubing 36 of the main frame side members 24, and a metal U-shaped catch 234 pivotally carried by a handle 236. Handle 236 is pivotally mounted at 238 to a side protrusion 240 from each front frame channel 112. In normal operation each U-shaped catch 234 is secured around its associated hook 232 as shown in FIG. 17. This fixes the front wheel and main frames 18, 20 to each other. When the latch handle 236 is lifted as shown in FIG. 17, disconnecting the U-shaped catch 234 from the hook 232, then each front wheel frame 18 is free to move relative to the main frame 16.

Figure 18:
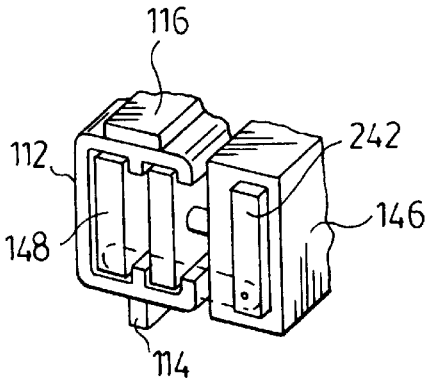
FIG. 18 is a perspective view showing a front flip plate used in the forklift vehicle of FIG. 1.
Figure 19:
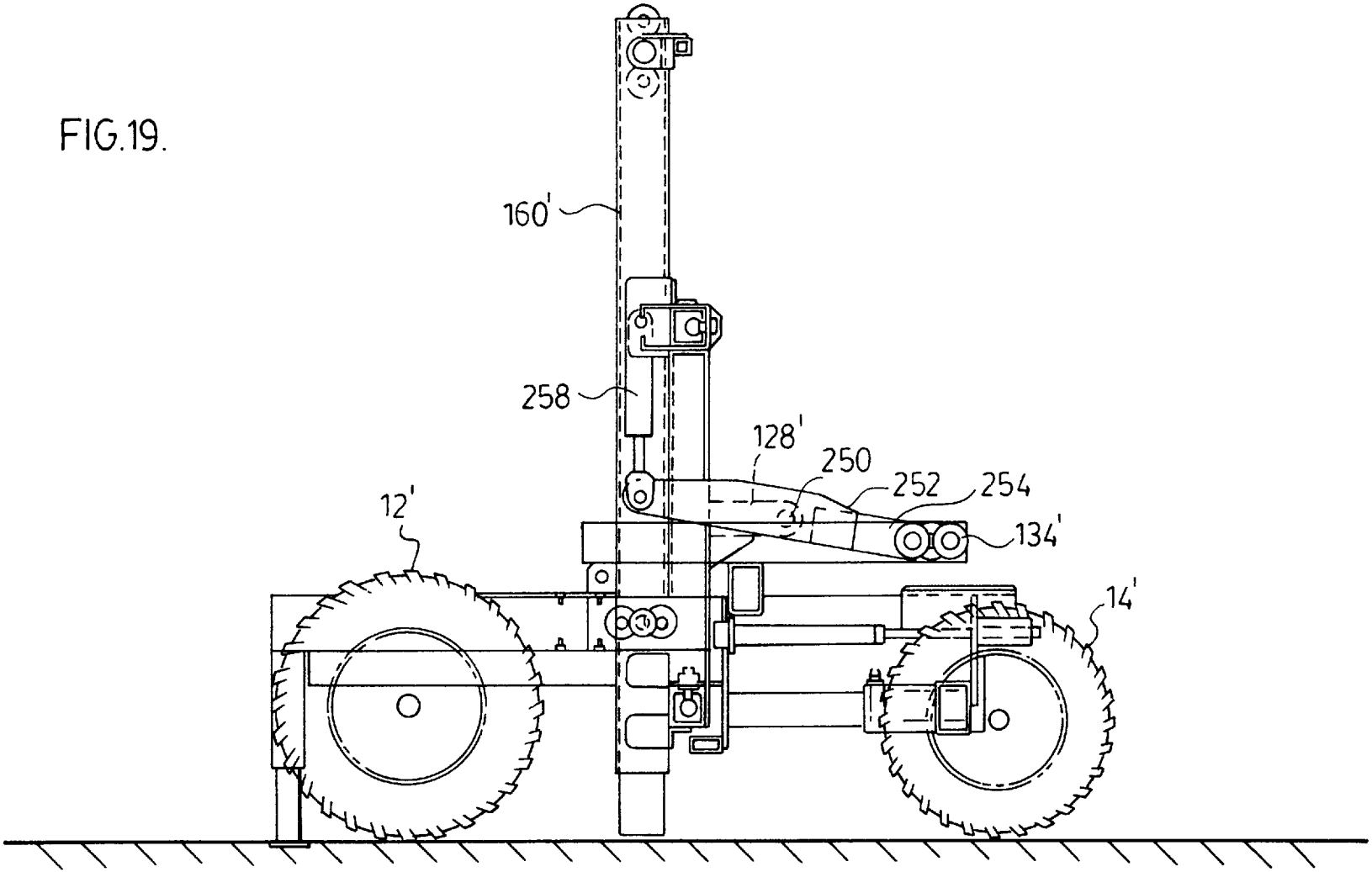
FIG. 19 is a side view of a modified embodiment of the forklift vehicle of FIG. 1.
Figure 20:
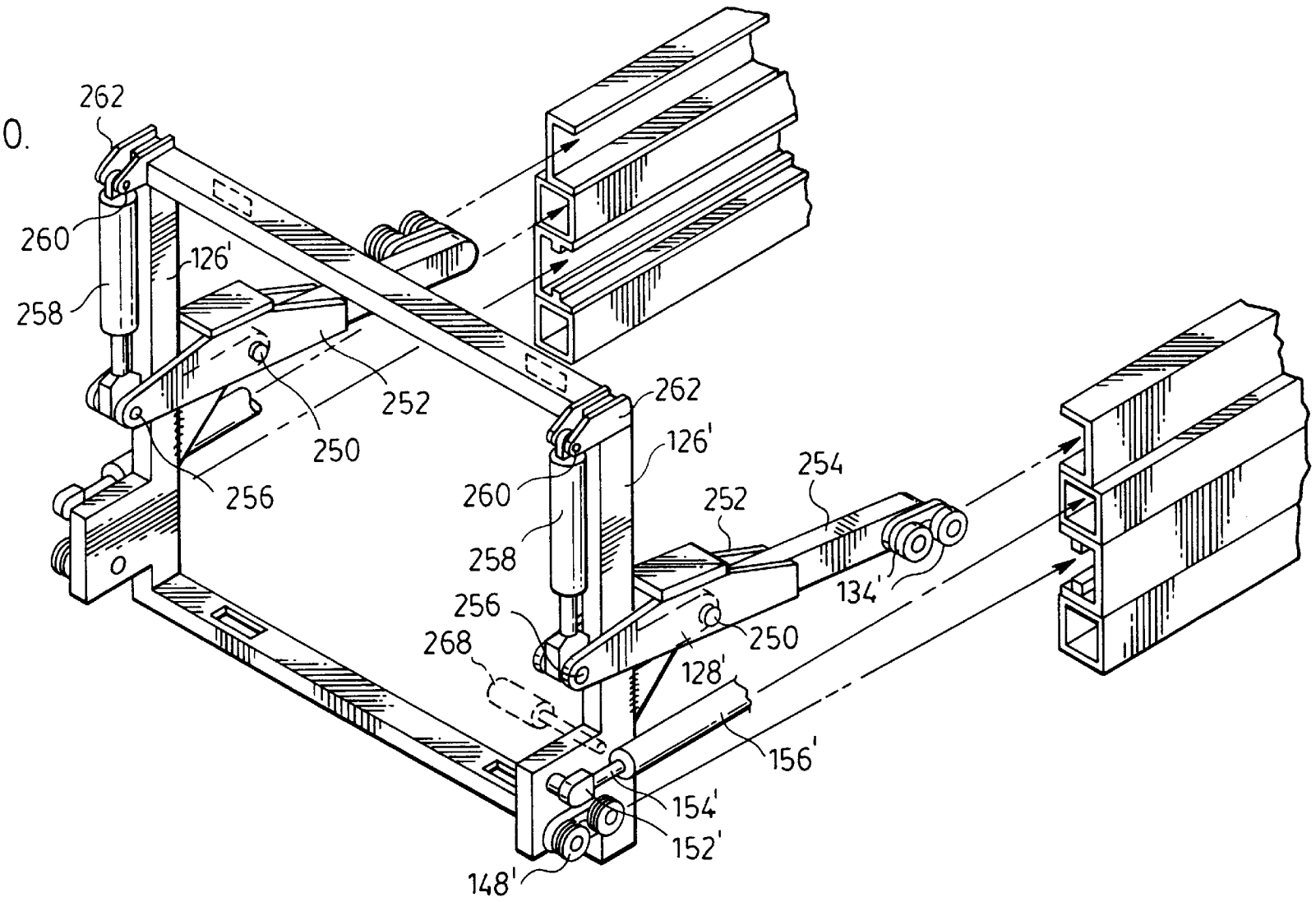
FIG. 20 is a perspective view of the mast frame and mast frame tilt mechanism for the forklift vehicle of FIG. 19.
Figure 21:
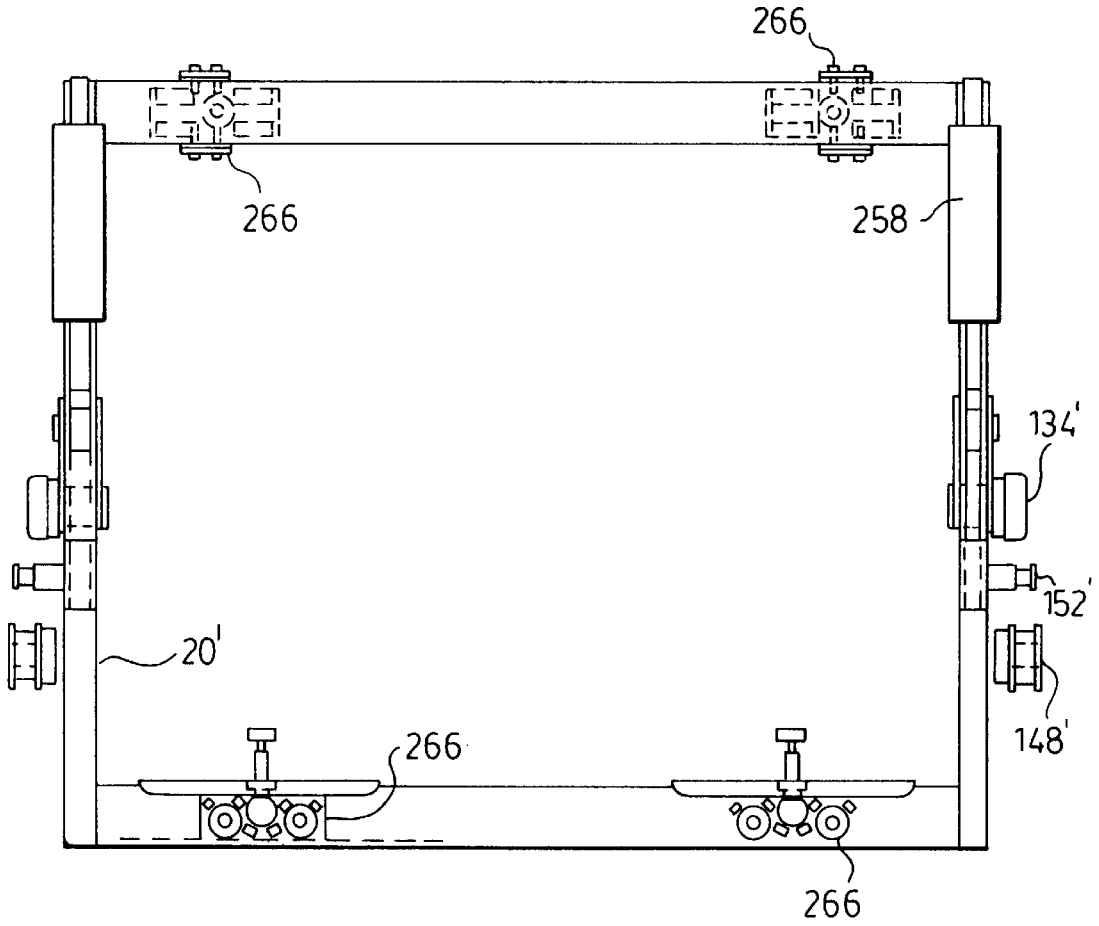
FIG. 21 is a front view of the mast frame for the forklift vehicle of FIG. 19.
Figure 22:
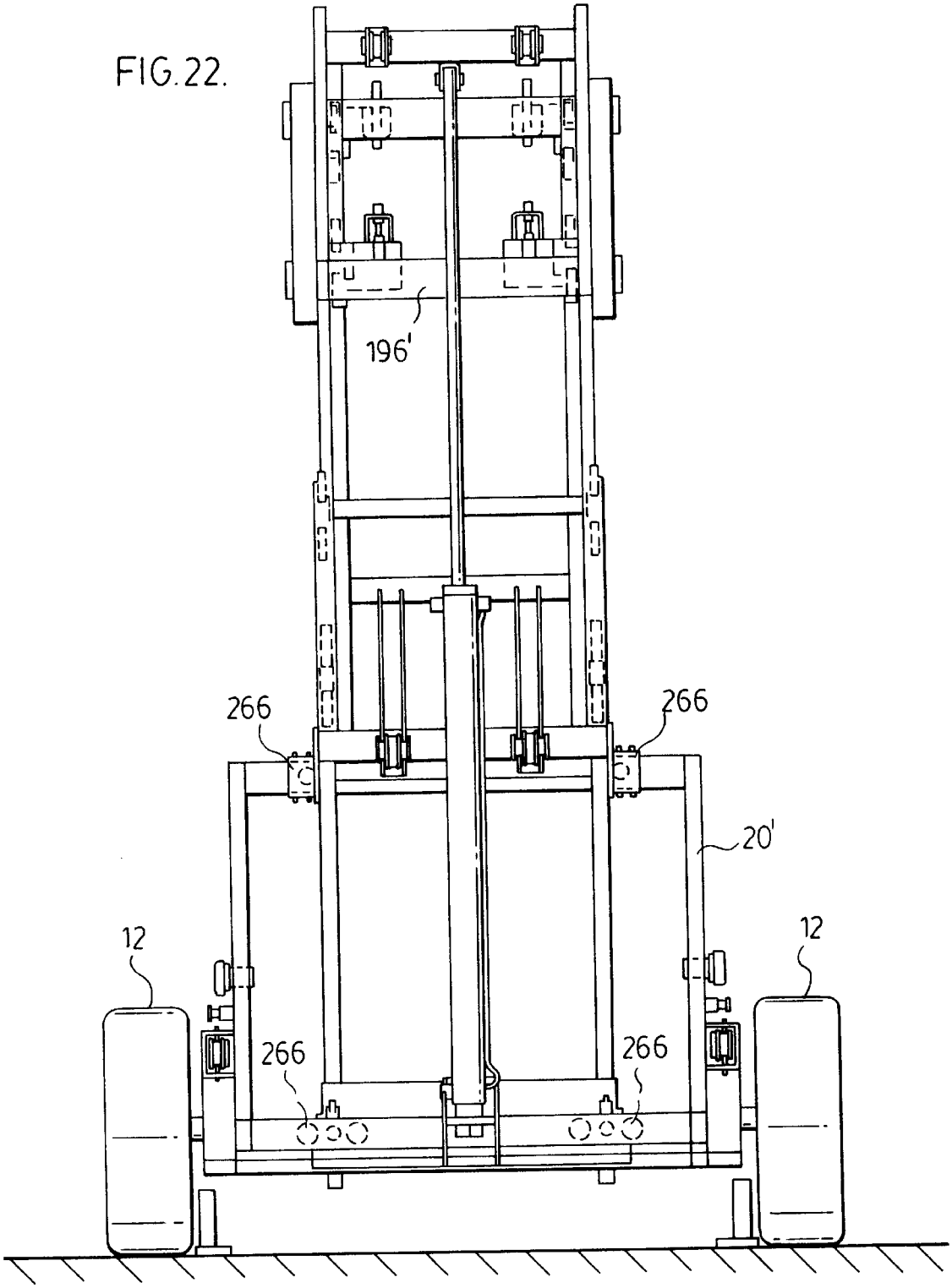
FIG. 22 is a front view of a portion of the forklift vehicle of FIG. 19.

Next, to retract the front wheel frames 18, metal pivot latches 242 which are mounted on the front of each mast frame lower forwardly projecting arm 146 are pivoted to the dotted line position shown in FIG. 18. In this position, pivot latches 242 lie in front of the front edges of front wheel frame channels 112.

Then when the mast frame 16 is retracted (using cylinder 156), it carries the front wheel frame members 18 with it. This retracts the front wheels 12 to the position shown in FIG. 3.

Next, the rear piston and cylinder 88 are activated, pulling the rear axle 56 and motor and seat subframe 46 forwardly to the position shown in FIG. 4. The vehicle is now fully retracted and ready for transport on a truck. If desired, the rear wheels 14 can be retracted after, rather than before, the vehicle has been raised onto a truck.

It will be realized that various modifications can be made in the vehicle described. For example, in some applications it is unnecessary to retract the front wheels, and the front wheel frames can then be fixed. In addition, side shifting and tilting of the mast may be accomplished by a variety of known means, as well as by the swing arms and tilt cylinders described.

In addition, while the motor and seat mount subframe have been described as staying level while the rear wheels tilt from side to side, the motor mount and seat subframe if desired can be pivoted to tilt when the rear axle and wheels tilt (e.g. by mounting the motor mount and seat subframe directly to the rear axle).

It will be seen that when the rear wheels, and the motor and seat subframe, are extended, these parts act as a counter weight to a load positioned on the forks 204 of the vehicle. A fuel tank (not shown) can also be positioned on the motor and seat subframe 46, adding additional counterweight. When these assemblies are moved forward for transport, the overhang of these parts rearwardly is of course reduced, thereby reducing the moment arm action of the forklift vehicle at the rear end of the transport truck which is carrying the forklift vehicle.

Reference is next made to FIGS. 19 to 22 which show a modified embodiment of the invention and in which primed reference numerals indicate parts corresponding to those of FIGS. 1 to 18. The major difference between the embodiments shown in FIGS. 19 to 22 and that previously described is that in the FIGS. 19 to 22 embodiment, the mast frame 20' has been modified to provide a different tilt arrangement therefor and to eliminate the side shift swing arms 210 while providing a different side shift arrangement for the mast 160'.

In particular, rearwardly extending arms 128' now carry a pivot shaft 250 on which is mounted a fore and aft extending pivot link 252. Each pivot link 252 is welded at its rear end to a rearwardly extending arm 254 which carries the rollers 134' which are guided in the upper channel 38'. Each pivot link 252 also extends forwardly of its associated mast frame side member 126' and terminates at a pivotal connection 256 to an upright piston and cylinder 258. The butt end of piston and cylinder 258 is pivotally connected at 260 to a forward projection 262 at the top of each mast frame side member 126'.

With the mechanism described, when the piston and cylinders 258 are extended, it will be seen that the mast frame 16' will be tilted rearwardly. When the piston and cylinders 258 are retracted, the mast frame 16' will be tilted forwardly. This arrangement eliminates the previous tilt cylinders 138 which may intrude into the workspace of the operator.

In the FIGS. 19 to 22 embodiment, side shifting of the mast 160' is performed by mounting it on a set of side shift roller carriages 266 (FIG. 21) mounted on the upper and lower cross members of the mast frame 20'. A conventional side shift piston and cylinder shown in dotted outline at 268 is used to side shift the mast.

While the invention has been described in connection with a forklift vehicle, the vehicle can also be a different type of tool carrying vehicle. For example it can carry a blade, a drilling or digging attachment, or another tool other than a forklift.

While preferred embodiments of the invention have been described, it will be appreciated that various modifications can be made within the scope of the invention, and all such modifications are intended to be encompassed by the appended claims.

The embodiments of the invention in which an exclusive property or privilege is claimed are defined as follows:

1. A vehicle having a front and a rear and comprising:

(a) a main frame, (b) said main frame including a pair of side members defining a space therebetween, and a support member extending rearwardly in said space, (c) a rear axle mounted on said support member for movement forwardly and rearwardly on said support member, and a rear wheel mounted on said axle, (d) a steering mechanism for steering said rear wheel, (e) and a retraction mechanism coupled between said rear axle and said main frame for moving said rear axle forwardly and rearwardly along said support member to extend and retract said rear axle and said rear wheel.

2. A vehicle according to claim 1 and including a subframe located over said rear axle and mounted to move in unison forwardly and rearwardly with said rear axle, and a motor for said vehicle mounted on said subframe.

3. A vehicle according to claim 2 and including an operator seat mounted on said subframe.

4. A vehicle according to claim 2 wherein said rear axle has a pair of laterally spaced ends, and a rear wheel mounted at each said end.

5. A vehicle according to claim 4 wherein said support member comprises a tube of circular cross-section, said rear axle including a slide ring mounted on said tube for said forward and rearward movement thereon and also for rotation on said tube, whereby said rear axle can tilt from side to side.

6. A vehicle according to claim 5 wherein said main frame includes a pair of second support members located above said slide tube and extending rearwardly in said space, said subframe being mounted on said second support members.

7. A vehicle according to claim 6 wherein said retraction mechanism includes a piston and cylinder coupled to said subframe to move said subframe forwardly and rearwardly, said subframe being coupled to said slide ring for corresponding forward and rearward movement of said rear axle.

8. A vehicle according to claim 7 and including a drive member extending downwardly from said subframe and connected to said slide ring for driving said slide ring forwardly and rearwardly with said subframe and for allowing rotation of said slide ring relative to said drive member, so that said rear axle can pivot from side to side while said subframe does not pivot.

9. A vehicle according to claim 8 wherein said drive member is a thrust plate having a bottom edge of arcuate configuration, said slide ring having an upper surface and a groove in said upper surface, the arcuate bottom edge of said thrust plate being received in said groove.

10. A vehicle according to claim 1 and including a pair of front wheel frames, one connected to each of said side members of said main frame for movement forwardly and rearwardly relative to said main frame, and a front wheel connected to each front wheel frame.

11. A vehicle according to claim 10 and being a forklift vehicle, said vehicle including a mast frame, and a fork mast carried by said mast frame, said mast frame having rear support rollers guided on said side members of said main frame and front support rollers guided on said front wheel frames, for permitting forward and rearward movement of said mast frame on said main and front wheel frames.

12. A vehicle according to claim 11 and including a piston and cylinder connected between said main frame and said mast frame for moving said mast frame forwardly and rearwardly.

13. A vehicle according to claim 12 wherein said mast frame includes a pair of side elements, said front and rear rollers being connected to said side elements, said fork mast frame further including upper and lower cross elements joining said side elements, and a pair of laterally spaced swing arms connected to said upper cross element and extending downwardly therefrom, said swing arms being connected to said fork mast to permit lateral movement of said fork mast.

14. A vehicle according to claim 13 wherein said fork mast has an inner frame and an outer frame, each of said inner and outer frames having channel-shaped side members, each channel-shaped side member of the inner frame facing into the channel-shaped side member of the outer frame, each channel-shaped side member of the inner frame carrying a pair of rollers to run in the associated channel-shaped side member of the outer frame, each channel-shaped side member of the outer frame carrying another pair of rollers at an opposite end of the mast frame to run in the channel-shaped side member of the inner frame.

15. A vehicle according to claim 12 wherein each side member of said main frame has an upper longitudinally extending channel to receive said rear rollers of said mast frame, a lower longitudinally extending channel to receive a said front wheel frame, and an enclosed tube between said upper and lower channels to accommodate a piston rod of said piston and cylinder.

* * * * *